United States Patent [19]

Ong et al.

[11] Patent Number: 5,023,159

[45] Date of Patent: Jun. 11, 1991

[54] ENCAPSULATED ELECTROPHOTOGRAPHIC TONER COMPOSITIONS

[75] Inventors: Beng S. Ong, Mississauga; Grazyna Kmiecik-Lawrynowicz, Burlington, both of Canada

[73] Assignee: Xerox Corporation, Stamford, Conn.

[21] Appl. No.: 419,425

[22] Filed: Oct. 10, 1989

[51] Int. Cl.[5] ..... G03G 11/00

[52] U.S. Cl. ..... 430/109; 430/111; 430/138; 430/904; 428/402.24

[58] Field of Search ..... 430/109, 111, 138, 904

[56] References Cited

U.S. PATENT DOCUMENTS

| | | | |
|---|---|---|---|
| 3,830,750 | 8/1974 | Wellman | 430/111 |
| 4,430,408 | 2/1984 | Sitaramiah | 430/106.6 |
| 4,708,924 | 11/1987 | Nagai et al. | 430/138 |
| 4,758,491 | 7/1988 | Alexandrovich et al. | 430/110 |
| 4,770,968 | 9/1988 | Georges et al. | 430/108 |
| 4,814,253 | 3/1989 | Gruber et al. | 430/106.6 |
| 4,820,604 | 4/1989 | Manca et al. | 430/110 |

*Primary Examiner*—David Welsh

*Attorney, Agent, or Firm*—E. O. Palazzo

[57] ABSTRACT

An encapsulated toner composition comprised of a core comprised of a silane-modified polymer resin and pigment or dyes; and a polymeric shell.

44 Claims, No Drawings

ENCAPSULATED ELECTROPHOTOGRAPHIC TONER COMPOSITIONS

BACKGROUND OF THE INVENTION

The present invention is generally directed to toner compositions, and more specifically to encapsulated toner compositions. In one embodiment, the present invention is related to encapsulated toner compositions comprised of a core comprised of a silane modified polymer resin, and a polymeric shell thereover preferably prepared by interfacial polymerization. Another specific embodiment of the present invention relates to encapsulated toner compositions comprised of a core comprised of a silane-modified polymer resin, and dye or pigment particles, which core is encapsulated by a polymeric coating such as a polyurea, polyurethane, polyamide, polyester, or mixtures thereof. In another embodiment of the present invention, there is provided an encapsulated toner composition comprising a core of silane modified polymer resin and a silane modified pigment, and encapsulated thereover a polymeric shell. In a specific embodiment of the present invention, there are provided encapsulated toner compositions comprised of a polymeric shell and a core comprised of dyes, pigments or mixtures thereof, and a copolymer of a monomer or monomers and a silane component which can be optionally partially grafted onto the surface of the pigment particles, thus rendering the pigment particles hydrophobic and compatible with the core polymer resin. Examples of advantages associated with the toner compositions of the present invention include the elimination or the minimization of image ghosting, improved toner fixing characteristics, superior release properties enabling their selection, for example, in imaging systems wherein a release fluid such as a silicone oil is avoided, no or minimal toner agglomeration, excellent powder flow characteristics, no or minimal leaching of the core components, and avoidance of core resin component adherence to, for example, dielectric receivers or photoreceptors. Other toner advantages relate to the surface modification of the pigments such as magnetites with suitable organosilane materials. The surface modification of pigment particles through grafting of core polymer resin with suitable organosilane components renders the pigment materials, such as magnetites, hydrophobic, thus improving their compatibility with the core polymer resin and their dispersibility within the toner core composition. Also, the modification of magnetite surfaces also enhances the magnetite's retentivity for the core polymer resin, and improves its adhesion characteristics to paper. The toner compositions of the present invention can be selected for a variety of known reprographic imaging processes including electrophotographic and ionographic processes. Preferably, the toner compositions are selected for pressure fixing processes wherein the image is fixed with pressure. Pressure fixing is common in ionographic processes in which latent images are generated on a dielectric receiver such as silicon carbide, reference copending application U.S. Pat. No. 4,885,220 entitled Amorphous Silicon Carbide Electroreceptors, the disclosure of which is totally incorporated herein by reference. The latent images can then be toned with a conductive toner by inductive single component development, and transferred and fixed simultaneously (transfix) in one single step onto paper with pressure. Specifically, the toner compositions of the present invention can be selected for the commercial Delphax printers such as the Delphax S9000, S6000, S4500, S3000, and Xerox printers such as the 4060 TM and 4075 TM wherein, for example, transfixing is utilized. In another embodiment of the present invention, the toner compositions of the present invention can be utilized in xerographic imaging apparatuses wherein image toning and transfer are accomplished electrostatically, and transferred images are fixed in a separate step by means of a pressure roll with or without the assistance of thermal energy fusing.

The toner compositions of the present invention can, in one specific embodiment, be prepared by first dispersing the toner precursor component materials into stabilized microdroplets of controlled droplet size and size distribution, followed by shell formation around the microdroplets via interfacial polymerization, and subsequently generating the core polymer resin by in situ addition polymerization, preferably free-radical polymerization within the newly formed microcapsules. Thus, in one embodiment, the present invention is directed to a process for the simple, and economical preparation of pressure fixable encapsulated toner compositions by interfacial/free-radical polymerization methods wherein there are selected as the core polymer resin precursors an addition-type monomer, or monomers and a polyfunctional organosilicon compound capable of undergoing addition polymerization as well as condensation reactions, a colorant including pigments, dyes or mixtures thereof, and shell-forming monomers capable of undergoing interfacial polymerization. Other process embodiments of the present invention relate to, for example, interfacial/free-radical polymerization processes for obtaining encapsulated colored toner compositions. Further, in another process aspect of the present invention the encapsulated toners can be prepared without organic solvents as the diluting vehicle or as a reaction medium, thus eliminating explosion hazards associated therewith; and furthermore, these processes therefore do not require expensive and hazardous solvent separation and recovery steps. Moreover, with the aforementioned process of the present invention there is obtained improved product yield per unit volume of reactor size since, for example, the extraneous solvent component can be replaced by liquid core and shell monomers. The aforementioned toners prepared in accordance with the process of the present invention are, as indicated herein, useful for permitting the development of images in reprographic imaging systems, inclusive of electrostatic imaging processes wherein pressure fixing, especially pressure fixing in the absence of heat, is selected.

Encapsulated and cold pressure fixable toner compositions are known. Cold pressure fixable toners have a number of advantages in comparison to toners that are fused by heat, primarily relating to the utilization of less energy since the toner compositions used can be fused at room temperature. Nevertheless, many of the prior art cold pressure fixable toner compositions suffer from a number of deficiencies. For example, these toner compositions must usually be fixed under high pressure, which has a tendency to severely disrupt the toner fixing characteristics of the toner selected. This can result in images of low resolution, or no images whatsoever. Also, with some of the prior art cold pressure toner compositions substantial image smearing can result from the high pressures used. The high fixing pressure also generates in some instances glossy images and objectionable paper calendering problem. Additionally, the preparative processes of the prior art pressure fixing toner compositions usually employ organic solvents as the diluting vehicles and reaction media, and these would drastically increase the toner's manufacturing cost because of the expensive solvent separation and recovery procedure, and the necessary precautions that have to be undertaken to prevent the solvent associated hazards. Moreover, the involvement of an organic solvent in the prior art processes also may decrease the product yield per unit volume of reactor size. In addition, the solvents in many prior art processes may have deleterious effects on toner particle morphology and bulk density as a result of their removal from the toner particles during the toner isolation stage, thus causing shrinkage or collapse of the toner particles, resulting in a toner of very low bulk density, which disadvantages are substantially eliminated with the process of the present invention. Furthermore, with many of the prior art processes narrow size dispersity toner particles cannot be easily obtained by conventional bulk homogenization techniques as contrasted with the process of the present invention wherein narrow size dispersity toner particles can be obtained. More specifically, thus with the encapsulated toners of the present invention, control of the toner physical properties of both the core and shell materials can be desirably achieved. Specifically, with the encapsulated toners of the present invention undersirable leaching or loss of core components is avoided, and image ghosting is eliminated, in many instances, primarily in view of the presence of a silane core polymer resin, and/or silane modified pigment particles as illustrated herein. Image ghosting is one of the common phenomena in ionographic printing processes. This refers to the unwarranted repetitious generation of images, and is related to the contamination of dielectric receiver by residual toner materials which cannot be readily removed in the cleaning process. The result is the retention of latent images on the dielectric receiver surface after cleaning, and the subsequent unwarranted development of these images. One of the common causes of image ghosting is related to the leaching of the sticky core polymer resin out to the toner's surface, leading to their adherence to the dielectric receiver during the image development process.

In a patentability search report, there was recited the following prior art, all U.S. Pat. Nos. 4,770,968 directed to polysiloxane butadiene terpolymer toner resins, reference for example column 4, and note the formulas of FIGS. 1 to 6, including FIG. 2B, which toners can be selected wherein silicone release oils are avoided, with no apparent teaching in this patent directed to encapsulated toners; 4,814,253 directed to encapsulated toners comprised of domains containing a polymer component having dispersed therein a release composition and thereover a host resin component comprised of toner resin particles and pigment particles, see for example the Abstract of the Disclosure and column 4, and note column 4 wherein there is illustrated as one of the components of the encapsulated toner domains comprised of styrene butadiene block polymers such as Kraton, styrene copolymers, or styrene siloxanes, which components have entrapped or dissolved therein mineral oils or silicon oils; and as background interest 4,430,408 relating to developer compositions containing a fluorene modified alkyl siloxane and a surface treatment carbon black, reference the Abstract of the Disclosure, for example; 4,758,491 relating to dry toner and developer compositions with a multiphase polyorgano siloxane block or graft condensation copolymer, which provides polyorgano siloxane domains of a particular size and concentration at the toner particle surfaces; and 4,820,604 directed to toner compositions comprised of resin particles, pigment particles, and a sulfur containing organo polysiloxane wax such as those of the formulas illustrated in the Abstract of the Disclosure.

There is disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there is disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent. Also, there is disclosed in the prior art encapsulated toner compositions containing in most instances costly pigments and dyes, reference for example the color photocapsule toners of U.S. Pat. Nos. 4,399,209; 4,482,624; 4,483,912 and 4,397,483.

Liquid developer compositions are also known, reference for example U.S. Pat. No. 3,806,354, the disclosure of which is totally incorporated herein by reference. This patent illustrates liquid inks comprised of one or more liquid vehicles, colorants such as pigments, and dyes, dispersants, and viscosity control additives. Examples of vehicles disclosed in the aforementioned patent are mineral oils, mineral spirits, and kerosene; while examples of colorants include carbon black, oil red, and oil blue. Dispersants described in this patent include materials such as poly(vinyl pyrrolidone). Additionally, there is described in U.S. Pat. No. 4,476,210, the disclosure of which is totally incorporated herein by reference, liquid developers containing an insulating liquid dispersion medium with marking particles therein, which particles are comprised of a thermoplastic resin core substantially insoluble in the dispersion, an amphipathic block or graft copolymeric stabilizer irreversibly chemically, or physically anchored to the thermoplastic resin core, and a colored dye imbibed in the thermoplastic resin core. The history and evolution of liquid developers is provided in the '210 patent, reference columns 1 and 2 thereof.

Moreover, illustrated in U.S. Pat. No. 4,758,506, the disclosure of which is totally incorporated herein by reference, are single component cold pressure fixable toner compositions, wherein the shell selected can be prepared by an interfacial polymerization process.

Disclosed in copending application U.S. Ser. No. 395,689 entitled Encapsulated Toner Compositions, the disclosure of which is totally incorporated herein by reference, are encapsulated compositions containing cores comprised of a fluorocarbon and a monomer or monomers. More specifically, there is illustrated in the aforementioned application an encapsulated toner composition comprised of a core with a fluorocarbon-incorporated resin binder, pigment or dyes, and a polymeric shell; and an encapsulated toner composition comprised of a core comprised of a fluorocarbon-incorporated resin binder derived from the copolymerization of an addition-type monomer and a functionalized fluorocarbon compound represented by Formula (I), wherein A is a structural moiety containing an addition-polymerization functional group; B is a fluorine atom or a structural moiety containing an addition-polymerization functional group; and x is the number of difluoromethylene functions, pigment or dyes, and a polymeric shell. Also, illustrated in U.S. Ser. No. 395,677 entitled Encapsulated Toner Compositions, the disclosure of which is totally incorporated herein by reference, is an encapsulated toner composition comprised of a core comprised of pigments or dyes, and a polysiloxane-incorporated core binder resin, which core is encapsulated in a shell.

Accordingly, there is a need for encapsulated toner compositions with many of the advantages illustrated herein. More specifically, there is a need for encapsulated toners wherein image ghosting is eliminated or minimized. Also, there is a need for pressure fixable encapsulated toners which offer quality images with good fixing levels, for example over 70 percent at low fixing pressure of, for example 2,000 psi. Moreover, there is a need for encapsulated toners, including colored toners wherein image ghosting, and the like are avoided or minimized. Additionally, there is a need for encapsulated toners, including colored toners with excellent release characteristics enabling their selection in imaging systems without the use of surface release fluids such as silicone oils to prevent image offsetting to the fixing or fuser roll. Furthermore, there is a need for encapsulated toners, including colored toners with substantially no toner agglomeration, long shelf life exceeding, for example, one year, and wherein the core polymer resin is a silane modified polymer resin. Also, there is a need for encapsulated toners that have been surface treated with additives such as carbon blacks, graphite or the like to impart to their surface certain conductive characteristics such as providing a volume resistivity of from about $1\times10^3$ ohm-cm to about $1\times10^8$ ohm-cm. Furthermore, there is a need for encapsulated toners wherein surface additives such as metal salts or metal salts of fatty acids and the like are utilized to assist in the release of the images from the imaging component to the paper substrate. There is also a need for simple and economic processes for the preparation of encapsulated toners. Specifically, there is a need for interfacial/free-radical polymerization processes for black and colored encapsulated toner compositions comprised of a hard polymeric shell and a soft core containing a silane-modified polymer resin and silane-modified pigment particles, and wherein organic solvents are eliminated in their preparation in some embodiments. Moreover, there is a need for enhanced flexibility in the design and selection of the shell and core materials for pressure fixable encapsulated toners, and/or flexibility controlling the toner physical properties such as the bulk density, particle size, and size dispersity.

SUMMARY OF THE INVENTION

It is an object of the present invention to provide encapsulated toner compositions with many of the advantages illustrated herein.

In another object of the present invention there are provided encapsulated toner compositions comprised of a core of silane modified polymer resin, pigments and/or dyes and thereover a shell prepared, for example, by interfacial polymerization.

Another object of the present invention is the provision of encapsulated toners wherein image ghosting is eliminated in some embodiments, or minimized in other embodiments.

Further, another object of the present invention is the provision of encapsulated toners wherein toner agglomeration is completely eliminated.

Another object of the present invention is the provision of encapsulated toners with excellent flow properties.

Also, another object of the present invention is the provision of encapsulated toners wherein core component leaching or loss is eliminated in some embodiments, or minimized in other embodiments.

Moreover, another object of the present invention is the provision of encapsulated toners wherein image offsetting is eliminated in some embodiments, or minimized in other embodiments.

Additionally, another object of the present invention is the provision of encapsulated toners with extended shelf life.

Further, another object of the present invention is the provision of encapsulated toners with excellent release properties.

Also, another object of the present invention is the provision of colored, that is other than black encapsulated toners.

It is another object of the present invention to provide encapsulated toners wherein contamination of the imaging member such as a dielectric receiver or a photoreceptor is eliminated or minimized.

Another object of the present invention is the provision of encapsulated toners that can be selected for imaging processes, especially processes wherein cold pressure fixing is selected.

In another object of the present invention, there are provided simple and economical processes for black, and colored toner compositions prepared by an interfacial/free-radical polymerization process in which the shell formation by interfacial polymerization, the core binder formation by free-radical polymerization, together with the resulting toner properties, can be independently and desirably controlled.

Another object of the present invention resides in the provision of colored and black encapsulated toner compositions which provide a high image fix level of, for example, over 70 percent at a relatively low fixing pressure of, for example, 2,000 psi.

A further objective of the present invention is to provide encapsulated toner compositions which are suitable for duplex imaging applications.

Another objective of the present invention is to provide colored and black encapsulated toner compositions which are suitable for inductive single component development.

Additionally, in another object of the present invention there are provided insulative encapsulated toner compositions for use in electrostatic imaging and printing apparatuses.

These and other objects of the present invention are accomplished by the provision of toners and more specifically encapsulated toners. In one embodiment of the present invention, there are provided encapsulated toners with a soft core comprised of silane modified polymer resin, a colorant, and a polymeric shell thereover. Specifically, in one embodiment there is provided in accordance with the present invention encapsulated toners comprised of a core containing a silane-modified polymer resin preferably obtained by free-radical polymerization, silane-modified pigment particles or dyes, and thereover a shell preferably obtained by interfacial polymerization.

The present invention in one embodiment is directed to an encapsulated toner composition comprised of a core comprised of the polymer product of a monomer or monomers, and a polyfunctional organosilicon component, and more specifically wherein the core is comprised of a silane-modified polymer resin having incorporated therein an oxysilyl (I), a dioxysilyl (II), or a trioxysilyl (III) function of the following formula, pigment dye particles or mixtures thereof; and a polymeric shell.

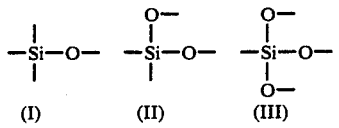

(I) (II) (III)

The aforementioned toners of the present invention can be prepared by a number of different processes including the interfacial/free-radical polymerization process which comprises (1) mixing or blending of a core monomer or monomers, up to 25 in some embodiments, a functionalized organosilane, a free-radical initiator or initiators, pigment, and a shell monomer or monomers; (2) dispersing the resulting mixture of pigmented organic materials by high shear blending into stabilized microdroplets in an aqueous medium with the assistance of suitable dispersants or emulsifying agents; (3) thereafter subjecting the aforementioned stabilized microdroplets to a shell forming interfacial polycondensation; and (4) subsequently forming the core resin binder by heat-induced free-radical polymerization within the newly formed microcapsules. The shell forming interfacial polycondensation is generally accomplished at ambient temperature, but elevated temperatures may also be employed depending on the nature and functionality of the shell monomer selected. For the core polymer resin forming free-radical polymerization, it is generally effected at a temperature of from ambient temperature to about 100° C., and preferably from ambient or room temperature, about 25° F. temperature to about 85° F. In addition, more than one initiator may be utilized to enhance the polymerization conversion, and to generate the desired molecular weight and molecular weight distribution.

Further, in accordance with the present invention there are provided processes for black and colored pressure fixable toner compositions which are obtained without organic solvents as the diluting vehicles or as reaction media. These processes involve dispersing a mixture of organic materials and colorants to form stabilized microdroplets in an aqueous medium containing a dispersant or emulsifying agent. The resulting organic mixture is comprised of from about 20 to about 75 weight percent of core monomer or monomers, about 0.01 to 20 weight percent of a functionalized organosilane such as an alkoxysilane, a halosilane, including a chlorosilane, siloxysilane, or other functionalized organosilane with a combination of alkyl, alkoxy, chloro and siloxy substituents, about 1 to 65 weight percent of a colorant or colorants, about 2 to 25 weight percent of a shell forming monomer component, and a free-radical initiator. The shell formation around the dispersed, stabilized microdroplets via interfacial polycondensation is initiated by adding to the reaction mixtures a shell forming, water-miscible monomer component into the aqueous phase. Subsequently, the reaction mixture is subjected to heating to initiate free-radical polymerization to form the desired core polymer resin within the newly formed microcapsules.

Examples of core monomers present in effective amounts, for example from about 20 to about 95 weight percent, selected include, but are not limited to, addition-type monomers such as propyl acrylate, propyl methacrylate, butyl acrylate, butyl methacrylate, hexyl acrylate, pentyl acrylate, pentyl methacrylate, hexyl acrylate, hexyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate,heptyl acrylate, heptyl methacrylate, isobutyl acrylate, isobutyl methacrylate, methylbutyl acrylate, methylbutyl methacrylate, tolyl acrylate, tolyl methacrylate, styrene, dodecyl styrene, hexyl methyl styrene, nonyl styrene, tetradecyl styrene, other substantially equivalent addition monomers, and the like. Suitable functionalized organosilanes that can be selected for incorporation into the core polymer resin structure by reaction thereof with the monomer or monomers as well as to modify the surface of pigment particles are alkoxysilanes, halosilanes, including preferably chlorosilanes, siloxysilanes containing an addition-polymerization functionality such as an acryloxy, methacryloxy, styryl group, and the like. The functionalized organosilane selected is capable of undergoing copolymerization with the core monomer or monomers up to, for example, 25 monomers may be selected in some embodiments. The functionalized alkoxysilane, halosilane including chlorosilane, siloxysilane or other functionalized organosilane with alkyl, alkoxy, chloro, siloxy, or the like, substituents can be employed in an effective amount of, for example, from about 0.01 to about 20 weight percent, and preferably from about 0.01 to about 10 weight percent of the toner.

Various known colorants present in the core in an effective amount of, for example, from about 1 to about 65 percent by weight of toner, and preferably in an amount of from about 5 to about 60 weight percent that can be selected include carbon black, magnetites, such as Mobay magnetites MO8029, MO8060, Columbian magnetites, Mapico Blacks and surface treated magnetites, Pfizer magnetites CB4799, CB5300, CB5600, MCX6369, Bayer magnetites, Bayferrox 8600, 8610, Northern Pigments magnetites, NP-604, NP-608, Magnox magnetites TMB-100, or TMB-104, and other equivalent black pigments. As colored pigments there can be selected Heliogen Blue L6900, D6840, D7080, D7020, Pylam Oil Blue and Pylam Oil Yellow, Pigment Blue 1 available from Paul Uhlich & Company Inc., Pigment Violet 1, Pigment Red 48, Lemon Chrome Yellow DCC 1026, E.D. Toluidine Red and Bon Red C available from Dominion Color Corporation Ltd., Toronto, Ontario, NOVAperm Yellow FGL, Hostaperm Pink E from Hoechst, Cinquasia Magenta available from E.I. DuPont de Nemours & Company, and the like. Generally colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-(octadecyl sulfonamido) phthalocyanine, x-copper phthalocyanine pigment listed in the Color Index as Cl 74160, Cl Pigment Blue, and Anthrathrene Blue identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of Mapico Black, and cyan components may also be used as pigments with the process of the present invention.

Examples of shell polymers include polyureas, polyamides, polyesters, polyurethanes, mixtures thereof, and other similar polycondensation products. The shell amounts are generally from about 5 to about 30 weight percent of toner, and have a thickness generally, for example, of less than about 5 microns, and more specifically from about 0.1 micron to about 3 microns. Other shell polymers, shell amounts, and thicknesses can be selected provided the objectives of the present invention are achievable.

The shell forming monomer components present in the organic phase are preferably comprised of diisocyanates, diacyl chloride, bischloroformate, together with appropriate polyfunctional crosslinking agents such as triisocyanate, triacyl chloride, and the like. Illustrative examples of the shell monomer components include benzene diisocyanate, toluene diisocyanate, diphenylmethane diisocyanate, cyclohexane diisocyanate, hexane diisocyanate, adipoyl chloride, fumaryl chloride, suberoyl chloride, succinyl chloride chloride, phthaloyl chloride, isophthaloyl chloride, terephthaloyl chloride, ethylene glycol bischloroformate, diethylene glycol bischloroformate, and the like. The water-soluble, shell forming monomer components which are preferably added to the aqueous phase can be a polyamine or polyol including bisphenols, the nature of which is dependent on the shell characterization desired, for example. Illustrative examples of water soluble shell monomers that react with the aforementioned diisocyanates, and the like include ethylenediamine, triethylenediamine, diaminotoluene, diaminopyridine, bis(aminopropyl)piperazine, bisphenol A, bisphenol Z, and the like. When desired, a water soluble crosslinking component such as triamine or triol can also be added to improve the mechanical strength of the shell structure.

In one specific embodiment of the present invention, there is provided an improved process for the preparation of improved encapsulated toner compositions which process comprises mixing and dispersing a core monomer or monomers, a functionalized organosilane, a free-radical initiator, pigment particles or dyes, and a shell monomer component into microdroplets of specific droplet size and size distribution in an aqueous medium containing a dispersant or stabilizer wherein the volume average diameter of the microdroplet is preferably from about 5 microns to about 30 microns, and its volume average droplet size dispersity is preferably from about 1.2 to about 1.4 as determined from Coulter Counter measurements of the microcapsule particles after encapsulation; forming a microcapsule shell around the microdroplets via interfacial polymerization by adding a water soluble shell forming monomer component; and subsequently affecting a free-radical polymerization to form a core resin binder within the newly formed microcapsules by, for example, heating the reaction mixture from room temperature to about 100° C. for a period of from about 1 to about 10 hours. Stabilizers selected for the process of the present invention include water soluble polymers such as poly(vinyl alcohols), methyl cellulose, hydroxypropylcellulose and the like. Illustrative examples of free-radical initiators selected for the preparation of the toners of the present invention include azo compounds such as 2-2'-azodimethylvaleronitrile, 2-2'-azoisobutyronitrile, azobiscyclohexane-nitrile, 2-methylbutyronitrile or any combination of these azo compounds with the quantity of initiator(s) being, for example, from about 0.5 percent to about 10 percent by weight of that of core monomer(s). Interfacial polymerization processes selected for the toner shell formation and shells thereof are as illustrated, for example, in U.S. Pat. Nos. 4,000,087 and 4,307,169, the disclosures of which are totally incorporated herein by reference.

Illustrative specific examples of functionalized alkoxysilanes, chlorosilanes and siloxysilanes present in an effective amount, for example, in one embodiment in an amount of from 0.01 weight percent to about 20 weight percent of toner include (acryloxypropyl)methoxydimethylsilane, (acryloxypropyl)methyldichlorosilane, (acryloxypropyl)trimethoxysilane, (acryloxypropyl)trichlorosilane, (acryloxypropyl)methyl bis(trimethylsiloxy)silane, (acryloxypropyl)tris-(trimethylsiloxy)silane, (methacryloxypropenyl)trimethoxysilane, (methacryloxypropyl)methyl bis(trimethylsiloxy)silane, (methacryloxypropyl)chlorodimethylsilane, (methacryloxypropyl)ethoxy-dimethylsilane, (methacryloxypropyl)methyldichlorosilane, (methacryloxypropyl)methyldiethoxysilane, (methacryloxypropyl)trichlorosilane, (methacryloxypropyl)trimethoxysilane, (methacryloxypropyl)triethoxysilane, (methacryloxypropyl)tris(trimethylsiloxy)silane, (styrylmethylaminopropyl)trimethoxysilane, (styrylmethylaminoalkyl)triethoxysilane, (styrylmethylaminoalkyl)methyldimethoxylsilane, (styrylmethylaminoalkyl)methoxydimethylsilane, and the like. The functionalized silanes are reacted with the core monomer or monomers thereby preferably resulting in a core polymer thereof. Also, the silanes can be chemically grafted onto the surface of the pigment particles.

Surface additives can be selected for the toner compositions of the present invention including, for example, metal salts, metal salts of fatty acids, colloidal silicas, mixtures thereof, and the like, which additives are usually present in an amount of from about 0.1 to about 1 weight percent, reference U.S. Pat. Nos. 3,590,000; 3,720,617; 3,655,374 and 3,983,045, the disclosures of which are totally incorporated herein by reference. Preferred additives include zinc stearate and Aerosil R972.

Also, the toner compositions can be rendered conductive with, for example, a volume resistivity, which can be measured in a cell test fixture at 10 volts, of from about $1\times10^3$ ohm-cm to about $1\times10^8$ ohm-cm thus enabling by adding in effective amounts of, for example, from about 1 to about 10 weight percent to the surface thereof components such as carbon blacks, graphite, copper iodide, and other conductive metal salts, conductive organic or organometallic materials.

The following examples are being submitted to further define various species of the present invention. These examples are intended to be illustrative only and are not intended to limit the scope of the present invention. Also, parts and percentages are by weight unless otherwise indicated.

EXAMPLE I

A 16.7 micron average diameter conductive black encapsulated toner comprising a trimethoxysilane-modified poly(lauryl methacrylate) core resin and Bayferrox magnetite 8610 was prepared as follows.

A mixture of 103 grams of lauryl methacrylate, available as Rocryl 320 from Rohm and Haas Company, 11.4 grams of methacryloxypropyltrimethoxysilane, 2.85 grams each of 2,2'-azobis-(2,4-dimethylvaleronitrile) and 2,2'-azobis-(isobutyronitrile), and a solution of 47.1 grams of Isonate 143L in 20 milliliters of dichloromethane was mixed in a 2-liter Nalgene container with a Brinkmann polytron equipped with a PT 35/4 probe at 4,000 rpm for 30 seconds. Three hundred (300) grams of Bayferrox magnetite 8610 was then added, and the resulting mixture was homogenized by high sheer blending with the Brinkmann polytron at 8,000 rpm for 3 minutes. To the mixture was then added 1 liter, 0.12 percent (by weight), of an aqueous poly(vinyl alcohol) (88 percent hydrolyzed; MW, molecular weight average of 96,000) solution, and thereafter, the mixture was blended at 9,000 rpm with an IKA polytron equipped with a T45/4 G probe for 2 minutes. A solution of 37 milliliters of 1,4-bis(3-aminopropyl)piperazine in 80 milliliters of water was then added with constant stirring for 10 minutes to initiate the microcapsule shell forming reaction. Subsequently, the mixture was transferred to a 2-liter reaction kettle and was mechanically stirred at room temperature for approximately 1 hour to complete the shell forming polycondensation reaction. Thereafter, the mixture was heated in an oil bath to initiate the core binder-forming free radical polymerization. The temperature of the mixture was gradually raised from room temperature to a final temperature of 85° C. over a period of 1 hour. Heating was continued at this temperature for an additional 6 hours, and thereafter the mixture was cooled down to room temperature. The microcapsule toner product formed was then transferred to a 4-liter beaker, and washed repeatedly with water until the washing was clear, and the product was then sieved through a 180 micron sieve to remove coarse material. The resulting wet toner was transferred to a 2-liter beaker and was diluted with water to a total volume of 1.8 liter. Colloidal graphite, 22.7 grams, available as Aquadag E from Acheson Colloids, diluted with 100 milliliters of water, was added to the beaker, and the mixture was spray dried in a Yamato Spray Dryer at an air inlet temperature of 160° C., and an air outlet temperature of 80° C. The air flow was retained at 0.75 $m^3$/minute, while the atomizing air pressure was kept at 1.0 killigram/$cm^2$. The collected encapsulated dry toner (378 grams) was then screened through a 63 micron sieve. The encapsulated toner's volume average particle diameter, as measured on a 256 channel Coulter Counter, was 16.7 microns with a volume average particle size dispersity of 1.26.

Two hundred and forty (240) grams of the above toner was dry blended with a Greey blender, first with 0.96 gram of carbon black (Black Pearls 2000) for 2 minutes with the blending impeller operating at 3,500 RPM, and then with 3.6 grams of zinc stearate for another 6 minutes at an impeller speed of 3,000 RPM. The latter blending was continued until the volume resistivity of toner was from about $5\times10^4$ to about $5\times10^6$ ohm-cm. For this toner, the final volume resistivity was $1\times10^5$ ohm-cm as measured in a cell fixture at 10 volts. After dry blending, the toner was further sieved through a 63 micron sieve. The above prepared toner was evaluated in a Delphax S6000 printer. The images developed were transfixed at 55° C. with a transfix pressure of 2,000 psi. Print quality was evaluated from a checkerboard print pattern. The image optical density was measured with a standard integrating densitometer. Image fix was measured by the standardized tape pull method, and is expressed as a percentage of the retained image optical density after the tape test relative to the original image optical density. Image smearing was evaluated qualitatively by hand rubbing the fused checkerboard print using a blank paper under an applied force for a specific cycle time, and viewing the surface cleanliness of nonprinted and printed areas of the page. Image ghosting was evaluated visually. For the above prepared toner, the image fix level was 81 percent, and no image smear and no image ghosting were observed after 2,000 prints. No agglomeration of this toner was observed after seven months of storage.

EXAMPLE II

The preparation of a 15.5 micron conductive black encapsulated toner with a trimethoxysilane-modified lauryl methacrylate-stearyl methacrylate copolymeric core resin and Magnox magnetite TMB-100 is illustrated in the following example.

A mixture of 60.0 grams of lauryl methacrylate, 60.0 grams of stearyl methacrylate, 4.95 grams of methacryloxypropyltrimethoxysilane, 3.09 grams each of 2,2'-azobis(isobutyronitrile) and 2,2'-azobis(2,4-dimethylvaleronitrile), and 47.1 grams of Isonate 143L were mixed by high shear blending using a Brinkmann polytron equipped with a PT 35/4 probe at 4,000 rpm for 30 seconds. To the resulting clear organic mixture was added 290 grams of Magnox Magnetite TMB-100, and the mixture was homogenized for 3 minutes at 8,000 rpm using the aforementioned Brinkmann probe. One liter of 0.20 percent (by weight) of aqueous poly(vinyl alcohol) was then added, and the mixture was homogenized at 9,000 rpm for 2 minutes with an IKA polytron equipped with a T45/4 G probe. To the resulting suspension was added a solution of 37 milliliters of 1,4-bis(3-aminopropyl)piperazine in 80 milliliters of water, and the mixture was transferred to a 3-liter reaction kettle equipped with a mechanical stirrer and a temperature probe. The mixture was stirred at room temperature for 1 hour, and was subsequently heated in an oil bath over a period of 1 hour to a final reaction temperature of 85° C. Heating was continued at this temperature for an additional 6 hours. The reaction mixture was then worked up according to the procedure of Example I except that 24.2 grams instead of 22.7 grams of Aquadag E was employed during the spray-drying stage. There were obtained 375 grams of dry encapsulated toner. The volume average particle diameter of the toner was 15.5 microns with a volume average particle size dispersity of 1.32. The toner was then dry blended to yield a final volume resistivity of $2\times10^5$ ohm-cm with the cell of Example I. This toner was then evaluated in a Delphax S6000 printer, and exhibited a fix level of 83 percent with no image smear and no image ghosting for 2,000 prints.

EXAMPLE III

A 14.9 micron conductive black encapsulated toner with a silane modified poly(lauryl methacrylate) core resin and Northern Pigment magnetite NP-604 was prepared by the following procedure.

An encapsulated toner was prepared by repeating the procedure of Example I with the exception that 113 grams of lauryl methacrylate, 1.15 grams of methacryloxypropyltrimethoxysilane, and 300 grams of Northern Pigments magnetite NP-604, were employed. In addition, 1 liter of 0.18 percent (by weight) of aqueous solution of poly(vinyl alcohol) was selected. There resulted 370 grams of dry encapsulated toner. The toner's volume average particle diameter was 14.9 microns with a volume average particle size dispersity of 1.31. This toner was machine tested in a Delphax S6000 printer according to the procedure of Example I, and substantially similar results were obtained.

EXAMPLE IV

An 17.1 micron conductive black encapsulated toner comprising a silane-modified poly(lauryl acrylate) core resin and Northern Pigment NP-608 was prepared as follows.

An encapsulated toner was prepared in accordance with the procedure of Example I except that 120 grams of lauryl acrylate, 265 grams of NP-608, 1.0 gram of methacryloxypropyltrimethoxysilane, and 0.18 percent aqueous poly(vinyl alcohol) solution were utilized in place of, respectively, 103 grams of lauryl methacrylate, 300 grams of Bayferrox 8610, 11.4 grams of methacryloxypropyl-trimethoxysilane, and 0.12 percent aqueous poly(vinyl alcohol) solution. A total of 356 grams of dry encapsulated toner product was obtained. The volume average particle diameter for the toner obtained was 17.1 microns with a volume average particle size dispersity of 1.32. This toner was evaluated in a Xerox 4060 TM printer according to the procedure of Example I and substantially similar results were obtained.

EXAMPLE V

The following example illustrates the preparation of a 13.8 micron insulating black encapsulated toner comprising a silane modified lauryl methacrylate-n-butyl methacrylate copolymeric core resin.

An encapsulated toner was prepared in accordance with the procedure of Example I with 170 grams of lauryl methacrylate, 30 grams of n-butyl methacrylate, 2.0 grams of methacryloxypropyltrimethoxysilane, and 4.0 grams each of 2,2'-azo bis-(2,4-dimethylvaleronitrile) and 2,2'-azobis-(isobutyronitrile) in place of, respectively, 103 grams of lauryl acrylate, 11.4 grams of methacryloxypropyl-trimethoxysilane, and 2.85 grams each of 2,2'-azobis-(2,4-dimethylvaleronitrile) and 2,2'-azobis-(isobutyronitrile). In addition, 200 grams of Columbian magnetite Mapico Black and 0.16 percent of aqueous poly(vinyl alcohol) solution were employed instead of, respectively, 300 grams of Bayferrox 8610 and 0.12 percent of aqueous poly(vinyl alcohol) solution. Furthermore, to render the toner insulating, the wet toner was spray dried without Aquadag E, and dry blended with zinc stearate without the carbon black. There were obtained 360 grams of dry encapsulated toner with a volume average particle diameter of 13.8 and a volume average particle size dispersity of 1.37. This toner was machine tested in an experimental xerographic machine wherein images were generated, developed with the above prepared toner, transferred to a paper substrate, and subsequently pressure fixed with a pressure roll at 2,000 psi. The image fix level was 78 percent with clean image background, and no offset to the pressure roll.

EXAMPLE VI

A 13.5 micron conductive black encapsulated toner with a silane modified lauryl methacrylate-n-hexyl methacrylate copolymeric core resin and Pfizer magnetite MCX 6368 was prepared by the following procedure.

An encapsulated toner was prepared in accordance with the procedure of Example I except that 100 grams of lauryl methacrylate, 2.0 grams of methacryloxypropyltrimethoxysilane, 20 grams of hexyl methacrylate, and Pfizer magnetite MCX 6368 were employed instead of, respectively, 103 grams of lauryl methacrylate, 11.4 grams of methacryloxypropyltrimethoxysilane and Bayferrox 8610. In addition, 1 liter of 0.20 percent of aqueous solution of poly(vinyl alcohol) instead of 0.12 percent poly(vinyl alcohol) solution. There resulted 363 grams of dry encapsulated toner, and the toner's volume average particle diameter was 13.5 microns with a volume average particle size dispersity of 1.36. Evaluation of this toner was conducted in a Delphax S6000 printer according to the procedure of Example I, and substantially similar results were obtained.

EXAMPLE VII

A 20.2 micron conductive black encapsulated toner comprising a silane-modified poly(lauryl acrylate) core resin was prepared as follows.

An encapsulated toner was prepared in accordance with the procedure of Example I except that 120 grams of lauryl acrylate and 1.5 grams of methacryloxypropyltrimethoxysilane were utilized in place of, respectively, 103 grams of lauryl methacrylate and 11.4 grams of methacryloxypropyl-trimethoxysilane. In addition, 250 grams of Mapico Black magnetite was employed instead of Bayferrox 8610. A total of 358 grams of dry encapsulated toner product was obtained. The volume average particle diameter of the obtained toner was 20.2 with a volume average particle size dispersity of 1.30. This toner was evaluated in a Xerox 4060 TM printer according to the procedure of Example I and substantially similar results were obtained.

Other modifications of the present invention may occur to those skilled in the art subsequent to a review of the present application. These modifications, including equivalents thereof, are intended to be included within the scope of the present invention.

What is claimed is:

1. An encapsulated toner composition comprised of a core of a silane-modified polymer resin having incorporated therein an oxysilyl (I), a dioxysilyl (II), or a trioxysilyl (III) function, pigment, dye particles or mixtures thereof; and a polymeric shell.

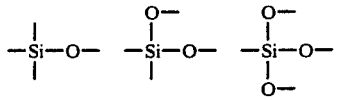

(I) (II) (III)

2. An encapsulated toner composition comprised of a core of a silane-modified polymer resin having incorporated therein an oxysilyl (I), a dioxysilyl (II), or a trioxysilyl (III) function, pigment, dye particles or mixtures thereof; and a polymeric shell; and wherein the core polymer resin is partially grafted onto the surface of the pigment particles by said siloxy function (I), (II), (III), or mixtures thereof.

3. An encapsulated toner composition in accordance with claim 1 wherein the core polymer resin is a silane-modified acrylate polymer, a silane modified methacrylate polymer, or a silane modified styrene polymer obtained by copolymerization, respectively, of an acrylate monomer, methacrylate monomer, or styryl monomer with a functionalized alkoxysilane, chlorosilane, or siloxysilane.

4. An encapsulated toner composition in accordance with claim 3 wherein the functionalized silane is selected from the group consisting of acryloxy-functionalized alkoxysilanes, methacryloxy-functionalized alkoxysilanes, styryl-functionalized alkoxysilanes, acryloxy-functionalized chlorosilanes, methacryloxy-functionalized chlorosilanes, styryl-functionalized chlorosilanes, acryloxy-functionalized siloxysilanes, methacryloxy-functionalized siloxysilanes, and styryl-functionalized siloxysilanes.

5. An encapsulated toner composition in accordance with claim 4 wherein the functionalized silane is selected from the group consisting of (acryloxypropyl)-methoxydimethylsilane, (acryloxypropyl)methyldichlorosilane, (acryloxypropyl)trimethoxysilane, (acryloxypropyl)trichlorosilane, (acryloxypropyl)methylbis(trimethylsiloxy)silane, (acryloxypropyl)tris(-trimethylsiloxy)silane, (methacryloxypropenyl)trimethoxysilane, (methacryloxypropyl)methylbis(trimethylsiloxy)silane, (methacryloxypropyl)chlorodimethylsilane, (methacryloxypropyl)ethoxydimethylsilane, (methacryloxypropyl)methyldichlorosilane, (methacryloxypropyl)methyldiethoxysilane, (methacryloxypropyl) trichlorosilane, (methacryloxypropyl)trimethoxysilane, (methacryloxypropyl)triethoxysilane, (methacryloxypropyl)tris(trimethylsiloxy)silane, (styrylmethylaminopropyl)trimethoxysilane, (styrylmethylaminoalkyl)triethoxysilane, (styrylmethylaminoalkyl)methyldimethoxylsilane, and (styrylmethylaminoalkyl)methoxydimethylsilane.

6. An encapsulated toner composition in accordance with claim 2 wherein the core polymer resin is a silane modified acrylate polymer, a silane modified methacrylate polymer, or a silane modified styrene polymer obtained by copolymerization, respectively, of an acrylate monomer, methacrylate monomer, or styryl monomer with a suitably functionalized alkoxysilane, chlorosilane or siloxysilane.

7. An encapsulated toner composition in accordance with claim 6 wherein the functionalized silane is selected from the group consisting of acryloxy-functionalized alkoxysilanes, methacryloxy-functionalized alkoxysilanes, styryl-functionalized alkoxysilanes, acryloxy-functionalized chlorosilanes, methacryloxy-functionalized chlorosilanes, styryl-functionalized chlorosilanes, acryloxy-functionalized siloxysilanes, methacryloxy-functionalized siloxysilanes, styryl-functionalized siloxysilanes, acryloxy-, methacryloxy, and styryl-functionalized silanes with a combination of alkoxy, chloro and siloxy substituents.

8. An encapsulated toner composition in accordance with claim 7 wherein the functionalized silane is (acryloxypropyl)methoxydimethylsilane, (acryloxypropyl)methyldichlorosilane, (acryloxypropyl)trimethoxysilane, (acryloxypropyl)trichlorosilane, (acryloxypropyl)methylbis(trimethylsiloxy)silane, (acryloxypropyl)tris(trimethylsiloxy)silane, (methacryloxypropenyl)trimethoxysilane, (methacryloxypropyl)methylbis(trimethylsiloxy)silane, (methacryloxypropyl)-chlorodimethylsilane, (methacryloxypropyl)ethoxydimethylsilane, (methacryloxypropyl)methyldichlorosilane, (methacryloxypropyl)methyldiethoxysilane, (methacryloxypropyl) trichlorosilane, (methacryloxypropyl)trimethoxysilane, (methacryloxypropyl)triethoxysilane, (methacryloxypropyl)tris(-trimethylsiloxy)silane, (styrylmethylaminopropyl)-trimethoxysilane, (styrylmethylaminoalkyl)triethoxysilane, (styrylmethylaminoalkyl)methyldimethoxylsilane, or (styrylmethylaminoalkyl)methoxydimethylsilane.

9. An encapsulated toner in accordance with claim 1 wherein the pigment is carbon black, magnetite, or mixtures thereof.

10. An encapsulated toner in accordance with claim 2 wherein the pigment is carbon black, magnetite, or mixtures thereof.

11. An encapsulated toner in accordance with claim 1 wherein the pigment is cyan, yellow, magenta, red, green, blue, brown, or mixtures thereof.

12. An encapsulated toner in accordance with claim 1 wherein the pigment is selected from the group consisting of Heliogen Blue, Pylam Oil Blue, Pylam Oil Yellow, Pigment Blue, Pigment Violet, Pigment Red, Lemon Chrome Yellow, Bon Red, NOVAperm Yellow FGL, Hostaperm Pink, Magenta 2,9-dimethyl-substituted quinacridone, Dispersed Red, Solvent Red, copper tetra-(octadecyl sulfonamido) phthalocyanine, copper phthalocyanine pigment, diarylide yellow 3,3-dichlorobenzidene acetoacetanilides, a nitrophenyl amine sulfonamide, Dispersed Yellow 2,5-dimethoxy-4-sulfonanilide phenylazo-4'-chloro-2,5-dimethoxy acetoacetanilide, and Permanent Yellow FGL.

13. An encapsulated toner in accordance with claim 1 wherein the shell is present in an amount of from about 3 to 30 weight percent of the toner, the silane-modified core polymer resin is present in an amount of from about 20 to about 95 weight percent of the toner, and the pigment or dye is present in an amount of from about 1 to about 65 weight percent of the toner.

14. An encapsulated toner in accordance with claim 1 containing surface additives.

15. An encapsulated toner in accordance with claim 14 wherein the surface additives are metal salts, metal salts of fatty acids, or colloidal silicas.

16. An encapsulated toner in accordance with claim 15 wherein zinc stearate is selected.

17. An encapsulated toner in accordance with claim 15 wherein the additives are present in an amount of from about 0.05 to about 5 weight percent.

18. An encapsulated toner in accordance with claim 1 wherein the silane-modified core polymer resin is prepared by free-radical polymerization.

19. An encapsulated toner in accordance with claim 1 wherein the shell is prepared by interfacial polymerization.

20. An encapsulated toner in accordance with claim 1 wherein the shell is a polyurea, a polyurethane, polyamide, a polyester, or mixtures thereof.

21. An encapsulated toner in accordance with claim 1 wherein the shell contains conductive components.

22. An encapsulated toner in accordance with claim 21 wherein the conductive components are comprised of carbon black, graphite, or mixtures thereof.

23. An encapsulated toner in accordance with claim 3 wherein the core monomer for the silane-modified core polymer resin is selected from the group consisting of n-butyl acrylate, s-butyl acrylate, isobutyl acrylate, butyl methacrylate, s-butyl methacrylate, isobutyl methacrylate, benzyl acrylate, benzyl methacrylate, propyl acrylate, isopropyl acrylate, hexyl acrylate, cyclohexyl acrylate, hexyl methacrylate, cyclohexyl methacrylate, lauryl acrylate, lauryl methacrylate, pentyl acrylate, pentyl methacrylate, stearyl acrylate, stearyl methacrylate, ethoxypropyl acrylate, ethoxypropyl methacrylate, heptyl acrylate, heptyl methacrylate, methylbutyl acrylate, methylbutyl methacrylate, m-tolyl acrylate, styrene, dodecyl styrene, hexylmethyl styrene, nonyl styrene, tetradecyl styrene, and mixtures thereof.

24. An encapsulated toner in accordance with claim 3 wherein the functionalized alkoxysilane, chlorosilane, or siloxysilane is present in an amount of from about 0.01 to about 20 weight percent.

25. An encapsulated toner comprised of a core comprised of a polymer obtained from the reaction of a monomer or monomers and functionalized silane; pigment, dyes, or mixtures thereof; and thereover a polymer shell.

26. An encapsulated toner in accordance with claim 25 wherein the silane is selected from the group consisting of (acryloxypropyl)methoxydimethylsilane, (acryloxypropyl)methyldichlorosilane, (acryloxypropyl)trimethoxysilane, (acryloxypropyl)trichlorosilane, (acryloxypropyl)methylbis(trimethylsiloxy)silane, (acryloxypropyl)tris(trimethylsiloxy)silane, (methacryloxypropenyl)trimethoxysilane, (methacryloxypropyl)methylbis(trimethylsiloxy)silane, (methacryloxypropyl)chlorodimethylsilane, (methacryloxypropyl)ethoxydimethylsilane, (methacryloxypropyl)methyldichlorosilane, (methacryloxypropyl)methyldiethoxysilane, (methacryloxypropyl) trichlorosilane, (methacryloxypropyl)trimethoxysilane, (methacryloxypropyl)triethoxysilane, (methacryloxypropyl)tris(-trimethylsiloxy)silane, (styrylmethylaminopropyl)-trimethoxysilane, (styrylmethylaminoalkyl)triethoxysilane, (styrylmethylaminoalkyl)methyldimethoxylsilane, and (styrylmethylaminoalkyl)methoxydimethylsilane.

27. An encapsulated toner in accordance with claim 25 wherein the shell is comprised of the reaction product of an isocyanate and an amine.

28. An encapsulated toner in accordance with claim 25 wherein the shell is a polyurea, a polyurethane, a polyamide, a polyester, or mixtures thereof.

29. An encapsulated toner in accordance with claim 25 wherein the shell contains conductive components.

30. An encapsulated toner in accordance with claim 29 wherein the resistivity thereof is from about $10^3$ to about $10^8$ ohm-cm.

31. An encapsulated toner in accordance with claim 29 wherein the conductive components are carbon black or graphite.

32. An encapsulated toner in accordance with claim 25 wherein the formed core polymer is chemically grafted onto the surface of the pigment of dye particles.

33. A toner composition comprised of a core comprised of (1) a polymer or polymers, and a polyfunctional organosilicon compound, and (2) pigment, dye, or mixtures thereof, which core is encapsulated within a polymeric shell.

34. A toner composition in accordance with claim 33 wherein the polyfunctional organosilicon compound is selected from the group consisting of (acryloxypropyl)-methoxydimethylsilane, (acryloxypropyl)methyldichlorosilane, (acryloxypropyl)trimethoxysilane, (acryloxypropyl)trichlorosilane, (acryloxypropyl)methylbis(trimethylsiloxy)silane, (acryloxypropyl)tris(-trimethylsiloxy)silane, (methacryloxypropenyl)trimethoxysilane, (methacryloxypropyl)methylbis(trimethylsiloxy)silane, (methacryloxypropyl)chlorodimethylsilane, (methacryloxypropyl)ethoxydimethylsilane, (methacryloxypropyl)methyldichlorosilane, (methacryloxypropyl)methyldiethoxysilane, (methacryloxypropyl) trichlorosilane, (methacryloxypropyl)trimethoxysilane, (methacryloxypropyl)triethoxysilane, (methacryloxypropyl)tris(trimethylsiloxy)silane, (styrylmethylaminopropyl)trimethoxysilane, (styrylmethylaminoalkyl)triethoxysilane, (styrylmethylaminoalkyl)methyldimethoxylsilane, and (styrylmethylaminoalkyl)methoxydimethylsilane.

35. A toner composition in accordance with claim 33 wherein the pigment is carbon black, magnetite, mixtures thereof; cyan, yellow, magenta, red, blue, green, brown, or mixtures thereof.

36. A toner composition in accordance with claim 33 wherein the polymer shell contains conductive components.

37. A toner composition in accordance with claim 36 wherein the components are carbon black, graphite, or mixtures thereof.

38. A toner composition in accordance with claim 36 with a conductivity of from about $10^3$ to about $10^8$ ohm-cm.

39. A toner composition in accordance with claim 33 wherein the polymeric shell is a polyurea, a polyurethane, a polyamide, a polyester, or mixtures thereof.

40. An encapsulated toner comprised of a core comprised of a polymer obtained from the reaction of a monomer or monomers and a functionalized silane, pigment, and thereover a polymeric shell; and wherein the core polymer is partially grafted onto the surface of the pigment.

41. An encapsulated toner in accordance with claim 40 wherein the functionalized silane is selected from a group consisting of acryloxy-funtionalized alkoxysilanes, methacryloxy-functionalized alkoxysilanes, styryl-functionalized alkoxysilanes, acryloxy-functionalized chlorosilanes, methacryloxy-functionalized chlorosilanes, styryl-functionalized chlorosilanes, acryloxy-functionalized siloxysilanes, methacryloxy-functionalized siloxysilanes, styryl-functionalized siloxysilanes, acryloxy-, methacryloxy-, and styryl-functionalized silanes with a combination of alkoxy, chloro and siloxy substituents.

42. An encapsulated toner in accordance with claim 40 wherein the functionalized silane is (acryloxypropyl) methoxydimethylsilane, (acryloxypropyl) methyldichlorosilane, (acryloxypropyl) trimethoxysilane, (acryloxypropyl) trichlorosilane, (acryloxypropyl) methylbis (trimethylsiloxy) silane, (acryloxypropyl) tris(trimethylsiloxy) silane, (methacryloxypropenyl) trimethoxysilane, (methacryloxypropyl) methylbis (trimethylsiloxy) silane, (methacryloxypropyl) chlorodimethylsilane, (methacryloxypropyl) ethoxydimethylsilane, (methacryloxypropyl) methyldichlorosilane, (methacryloxypropyl) methyldiethoxysilane, (methacryloxypropyl) trichlorosilane, (methacryloxypropyl) trimethoxysilane, (methacryloxypropyl) triethoxysilane, (methacryloxypropyl) tris(trimethylsiloxy) silane, (styrylmethylaminopropyl) trimethoxysilane, (styrylmethylaminoalkyl) triethoxysilane, (styrylmethylaminoalkyl) methyldimethoxylsilane, or (styrylmethylaminoalkyl) methoxydimethylsilane.

43. An encapsulated toner comprised of a core comprised of a polymer or plurality of polymers having incorporated therein a functionalized organo-silane pigment, dyes, or mixtures thereof and thereover a polymeric shell.

44. An encapsulated toner in accordance with claim 43 wherein the functionalized organo-silane is a copolymer obtained by the chemical reaction of said silane with the monomer selected for formation of the polymer.

* * * * *